US008749328B2

(12) United States Patent
Ham

(10) Patent No.: US 8,749,328 B2
(45) Date of Patent: Jun. 10, 2014

(54) SHORTAGE VOLTAGE TRIP DEVICE OF MOLDED CASE CIRCUIT BREAKER

(71) Applicant: LSIS Co., Ltd., Anyang-si (KR)

(72) Inventor: Seung Jin Ham, Cheongjoo (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/726,373

(22) Filed: Dec. 24, 2012

(65) Prior Publication Data

US 2013/0169387 A1 Jul. 4, 2013

(30) Foreign Application Priority Data

Dec. 30, 2011 (KR) ..... 10-2011-0146993

(51) Int. Cl.
*H01H 83/00* (2006.01)

(52) U.S. Cl.
USPC ..... 335/20

(58) Field of Classification Search
USPC ..... 335/20
See application file for complete search history.

(56) References Cited

U.S. PATENT DOCUMENTS

| | | | | |
|---|---|---|---|---|
| 3,088,009 | A * | 4/1963 | Pérez del Valle | 335/6 |
| 3,755,766 | A * | 8/1973 | Read, Jr. | 335/229 |
| 3,783,423 | A * | 1/1974 | Mater et al. | 335/174 |
| 3,886,507 | A * | 5/1975 | Johnston et al. | 335/234 |
| 4,013,926 | A * | 3/1977 | Lang et al. | 361/115 |
| 4,489,295 | A * | 12/1984 | Altenhof et al. | 335/20 |
| 4,553,116 | A | 11/1985 | Bagalini | |
| 4,641,117 | A | 2/1987 | Willard | |
| 4,806,893 | A * | 2/1989 | Castonguay et al. | 335/20 |
| 4,860,157 | A * | 8/1989 | Russell | 361/156 |
| 4,894,631 | A * | 1/1990 | Castonguay et al. | 335/167 |
| 4,913,503 | A * | 4/1990 | Castonguay et al. | 335/172 |

(Continued)

FOREIGN PATENT DOCUMENTS

| | | |
|---|---|---|
| EP | 0656641 | 6/1995 |
| KR | 2019990015635 | 5/1999 |
| KR | 2020000011849 | 7/2000 |
| KR | 1020100080088 | 7/2010 |

OTHER PUBLICATIONS

European Patent Office Application Serial No. 12199624.3, Search Report dated Apr. 8, 2013, 7 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

Provided is a shortage voltage trip device of a molded case circuit breaker. In the molded case circuit breaker, driving current applied into a trip driving part is reduced in proportion to reduction of a power applied into a circuit. When the voltage applied into the circuit is greater than a rated voltage, the trip driving part is stopped, and an operation of a trip driving mechanism is restricted by a trip lever. When the voltage applied into the circuit is less than the rated voltage, the trip driving part is operated, and the restriction of the trip driving mechanism is released by the trip lever rotated by being linked with the operation of the trip driving part. Thus, the circuit may be more simply switched, and operation reliability of a product may be improved. Also, the product may have a more simplified structure.

14 Claims, 7 Drawing Sheets

(56) References Cited

U.S. PATENT DOCUMENTS

| | | | | |
|---|---|---|---|---|
| 6,201,460 | B1 * | 3/2001 | Winslett et al. | 335/172 |
| 6,794,968 | B2 * | 9/2004 | Arnholt | 335/179 |
| 7,557,681 | B2 * | 7/2009 | Whitaker et al. | 335/14 |
| 7,598,830 | B2 * | 10/2009 | Bogdon et al. | 335/179 |

OTHER PUBLICATIONS

Korean Intellectual Property Office Application Serial No. 10-2011-0146993, Notice of Allowance dated May 27, 2013, 6 pages.

* cited by examiner

SHORTAGE VOLTAGE TRIP DEVICE OF MOLDED CASE CIRCUIT BREAKER

CROSS-REFERENCE TO RELATED APPLICATIONS

Pursuant to 35 U.S.C. §119(a), this application claims the benefit of earlier filing date and right of priority to Korean Patent Application No. 10-2011-0146993, filed on Dec. 30, 2011, the contents of which are hereby incorporated by reference herein in its entirety.

BACKGROUND

The present disclosure relates to a shortage voltage trip device of molded case circuit breaker.

Molded case circuit breakers are, for example, electronic devices which switch power circuit having a relatively low voltage of several hundred volts or less and perform a trip operation for automatically breaking the power circuit when abnormal current flows into the power circuit. Such a molded case circuit breaker includes a contact part for switching a power circuit, a handle for manually switching the contact part, a switching mechanism providing a driving force for switching the contact part, a trip bar for triggering so that the switching mechanism is tripped, a trip mechanism for detecting abnormal current such as overcurrent or short-circuit current on the power circuit to operate the trip bar, and an arc extinguishing mechanism for extinguishing an arc generated at the contact part during the trip operation.

The molded case circuit breaker may further include a shortage voltage trip device which interrupts the introduction of current into the circuit of the molded case circuit breaker when a voltage less than a rated voltage is applied and displays the interruption of the current.

FIG. 1 is a perspective view illustrating a shortage voltage trip device of a molded case circuit breaker according to a related art. FIG. 2 is an exploded perspective view of a tip driving mechanism constituting the shortage voltage trip device of the molded case circuit breaker according to the related art.

Referring to FIG. 1, various components for operating a switching mechanism of a molded case circuit breaker to open a circuit when a voltage less than a rated voltage is applied into a circuit may be installed within a casing 10 of a shortage voltage trip device 1 (hereinafter, referred to as a "trip device") of the molded case circuit breaker according to the related art.

In more detail, a printed circuit board (PCB) is disposed within the casing 10. The PCB 11 is connected to a line-side terminal 13 and a power source-side terminal 15 to calculate a voltage applied into the circuit, thereby determining whether the applied voltage is less than the rated voltage.

Also, a trip mechanism for operating the molded case circuit breaker to break the circuit when the voltage applied into the circuit is less than the rated voltage is installed within the casing 10. The trip mechanism includes a trip lever 17, a reset button 19, and a trip driving part 20.

The trip lever 17 is rotatably installed within the casing 10. The trip lever 17 operates the switching mechanism of the molded case circuit breaker to break the circuit when the voltage less than the rated voltage is applied into the circuit. That is, substantially, the trip lever 17 is rotated between a trip position for closing the circuit and a normal position for opening the circuit.

The reset button 19 protrudes to the outside of the casing 10 by being linked with the rotation of the trip lever 17 when the trip lever 17 is rotated and then disposed at the trip position. Thus, a user may recognize a trip state through the reset button 19 protruding to the outside of the casing 10. Also, when the transmission of a driving force from the trip driving part 20 into the trip lever 17 is finished, i.e., in a state where the driving current applied into a coil 23 is interrupted, the reset button 19 provides a driving force for rotating the trip lever 17 so that the trip lever 17 is disposed from the trip position to the normal position. That is, when the user presses and pushes the reset button in a direction in which the reset button 19 is inserted into the casing 10, the trip lever 17 is rotated by being linked with the insertion of the reset button 19 to rotate the trip lever 17 from the trip position to the normal position.

The trip driving part 20 may provide a driving force for rotating the trip lever 17 when the voltage applied into the circuit is less than the rated voltage.

Referring to FIG. 2, the trip driving part 20 includes a moving coil 21, a coil 23, a bobbin 27, a core spring 25, and a yoke 29.

In detail, the moving core 21 rotates the trip lever 17 to locate the trip lever 17 at the trip position. Also, the coil 23 surrounds the moving core 21. When the voltage less than the rated voltage is applied into the circuit, the coil 23 receives driving current from the PCB 11. When the driving current is applied into the coil 23, an electromagnetic force is generated. Thus, the moving core 21 is moved to rotate the trip lever 17 so that the trip lever 17 is disposed at the trip position. The bobbin 25 has a cylindrical shape. The coil 23 is wound around an outer surface of the bobbin 25. When the driving current applied into the coil 23 is interrupted, the core spring 27 provides an elastic force into the moving core 21 to move the moving core 21 to its original position. For this, the core spring 27 is pressed by the moving core 21 moved by the electromagnetic force generated in the coil 23 due to the apply of the driving current. The yoke 29 amplifies the electromagnetic force generated in the coil 23.

In the trip device 1, the PCB 11 determines whether a voltage applied into the circuit is less than the rated voltage. When the PCB 11 determines that the voltage applied into the circuit is less than the rated voltage, the PCB 11 applies driving current into the trip driving part 20. Thus, the moving core 21 is moved to rotate the trip lever 17 so that the trip lever 17 is disposed from the normal position to the trip position. Here, the core spring 27 is pressed by the moving core 21.

Also, when the trip lever 17 is rotated and then disposed at the trip position, the switching mechanism of the circuit breaker is operated to open the circuit. Also, since the reset button 19 is linked with the rotation of the trip lever 17 to protrude to the outside of the casing 10, the user may recognize the trip state.

When the voltage applied into the circuit is increased to excess the related voltage, the PCB 11 determines that the voltage applied into the circuit excesses the related voltage. Then, the PCB 11 interrupts the driving current applied into the trip driving part 20. Thus, the moving core 21 returns to its original position by the elastic force of the core spring 27. In this state, when the user presses the reset button 19 to insert the reset button 19 into the casing 10, the trip lever 17 is rotated by being linked with the movement of the reset button 19 so that the trip lever 17 is disposed from the trip position to the normal position. Also, after the trip lever 17 is disposed at the normal position, the user operates the switching mechanism of the circuit breaker to close the circuit.

However, the shortage voltage trip device of the molded case circuit breaker according to the related art has following limitations.

First, in the related art, to close the circuit tripped by the trip device 1, the trip device 1 should be operated (i.e., the reset button 19 should be manipulated) and the circuit breaker should be operated (i.e., the switching mechanism should be manipulated). Thus, the user should perform operations in two stages to close the circuit.

Also, in the related art, the driving current for the trip operation of the trip device 1 is substantially transmitted into the trip driving part 20 through the PCB 11. Thus, when a voltage applied into the circuit is zero voltage, the driving current is not applied into the trip driving part 20 from the PCB 11. For example, when a voltage applied into the circuit ranges from about 0% to about 15% of the rated voltage, the trip operation is not substantially performed.

Also, in the related art, the PCB 11 determines whether the voltage applied into the circuit is less than the rated voltage. Thus, a device for comparing voltages to each other should be provided on the PCB 11. As a result, as the PCB 11 is increased in price, manufacturing costs of the product may be substantially increased.

SUMMARY

Embodiments provide a shortage voltage trip device of a molded case circuit breaker.

In one embodiment, a shortage voltage trip device of a molded case circuit breaker, which performs a turn-on operation connected to a circuit switched by the molded case circuit breaker, a turn-off operation broken from the circuit, and a trip operation in a case where a voltage of a power applied into the circuit is less than a rated voltage, includes: a casing; a trip handle rotatably disposed in the casing, the trip handle being selectively disposed at a turn-of position and a turn-on position; a printed circuit board (PCB) disposed in the casing, the PCB being selectively connected to a line-side terminal and a power source-side terminal of the circuit; a trip driving mechanism linked with the rotation of the trip handle; a trip driving part selectively receiving an electromagnetic force from the PCB connected to the line-side terminal and the power source-side terminal, the trip driving part being operated or stopped according to an intensity of the electromagnetic force received from the PCB; a trip lever rotatably disposed within the casing, the trip lever being rotated by being linked with the operation of the trip driving part to allow the trip driving mechanism to be selectively operated; and a first trip spring applying an elastic force into the trip lever so that the trip driving part is rotated in a direction for maintaining the stopped state of the trip driving part or into the trip driving mechanism so that the trip driving mechanism is operated by being linked with the rotation of the trip handle disposed at the turn-off position, wherein, the voltage applied into the circuit is greater than the rated voltage, the trip driving part is stopped, and the operation of the trip driving mechanism is restricted by the trip lever, and when the voltage applied into the circuit is less than the rated voltage, the trip driving part is operated, and the restriction of the trip driving mechanism is released by the trip lever rotated by being linked with the operation of the trip driving part.

In another embodiment, a shortage voltage trip device of a molded case circuit breaker, which performs a turn-on operation connected to a circuit switched by the molded case circuit breaker, a turn-off operation broken from the circuit, and a trip operation in a case where a voltage of a power applied into the circuit is less than a rated voltage, includes: a casing; a trip handle rotatably disposed in the casing; a printed circuit board (PCB) disposed in the casing, the PCB being selectively connected to a line-side terminal and a power source-side terminal; a trip driving mechanism linked with the rotation of the trip handle; a trip driving part disposed within the casing, the trip driving part selectively receiving a driving power from the PCB connected to the line-side terminal and the power source-side terminal; a trip lever rotatably disposed within the casing, the trip lever being rotated by being linked with the trip driving part to selectively restrict an operation of the trip driving mechanism; and a first trip spring selectively applying an elastic force into the trip lever or the trip driving mechanism, wherein the trip driving part includes a moving core, during the turn-on operation or the turn-off operation, the moving core is disposed at a first position, and during the trip operation, the moving core is moved to a second position to rotate the trip lever.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
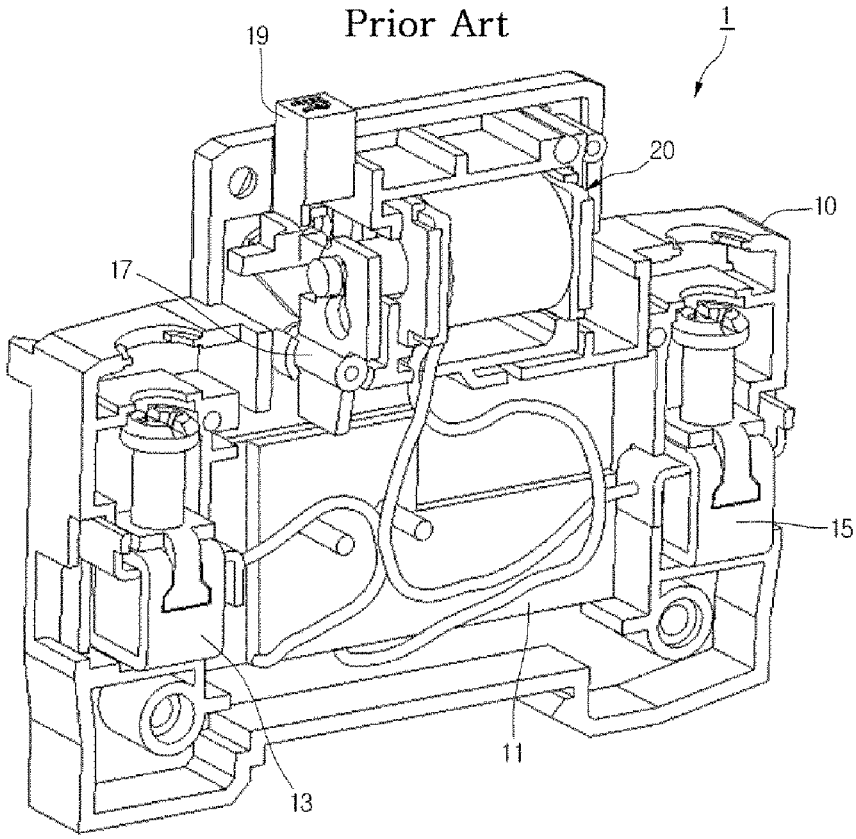
Fig.1 Prior Art
FIG. 1 is a perspective view illustrating a shortage voltage trip device of a molded case circuit breaker according to a related art.
Figure 2:
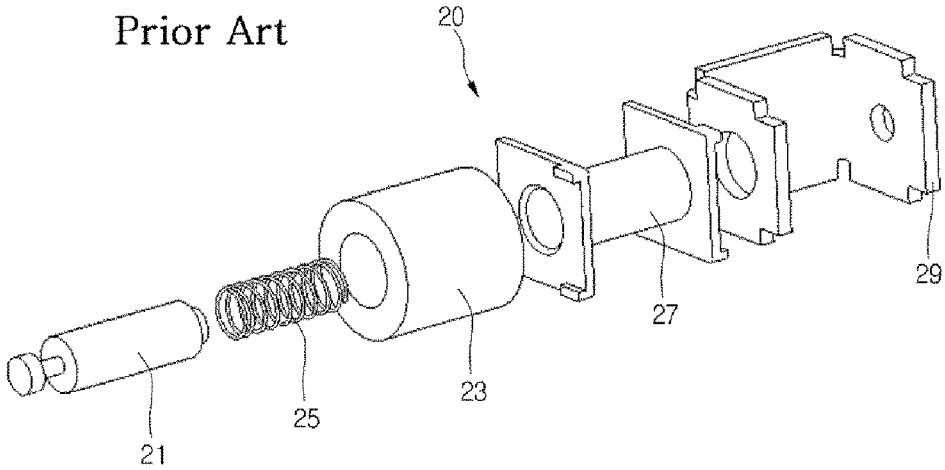
Fig.2 Prior Art
FIG. 2 is an exploded perspective view of a tip driving mechanism constituting the shortage voltage trip device of the molded case circuit breaker according to the related art.
Figure 3:
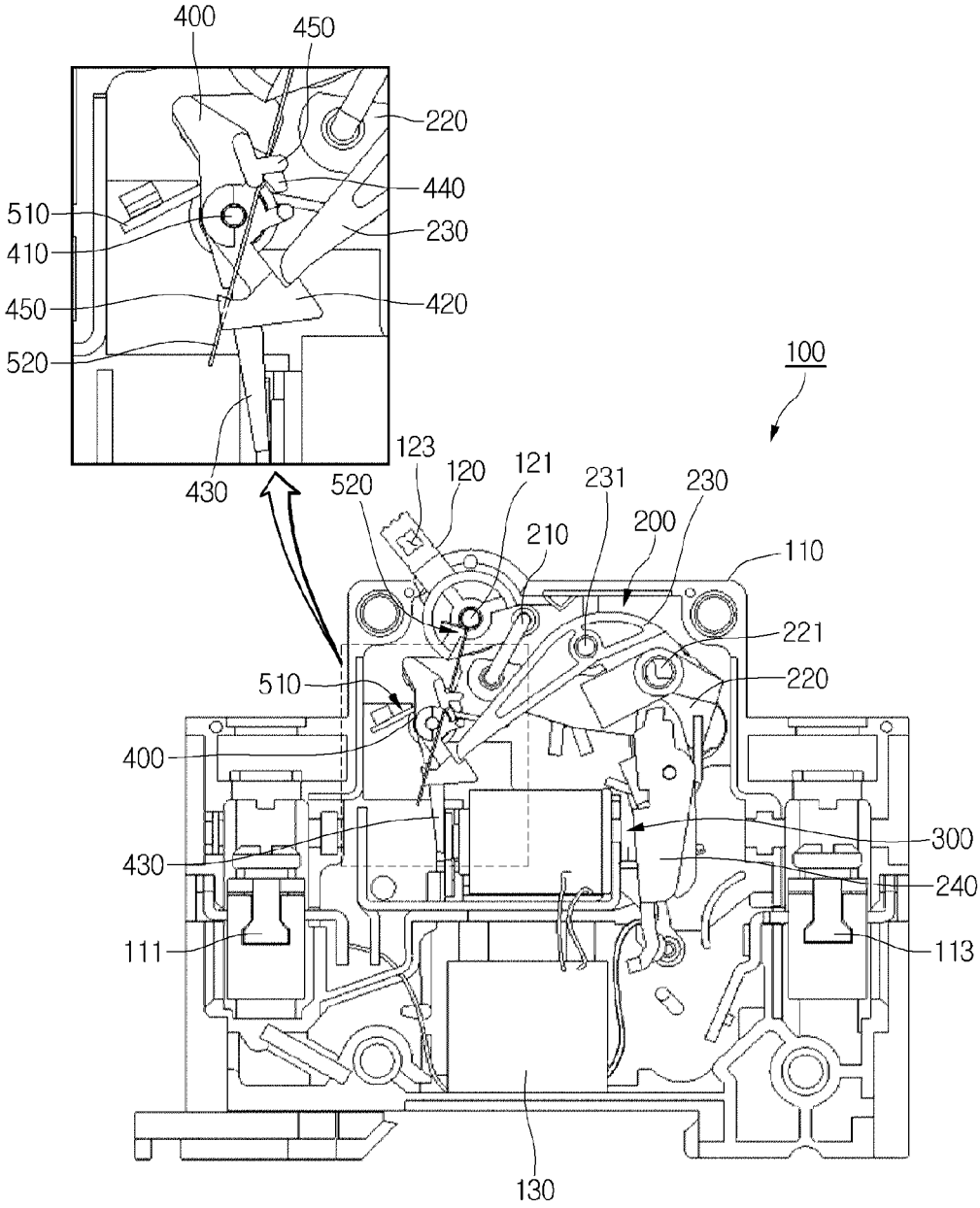
FIG. 3 is a perspective view illustrating a shortage voltage trip device of a molded case circuit breaker according to an embodiment.
Figure 4:
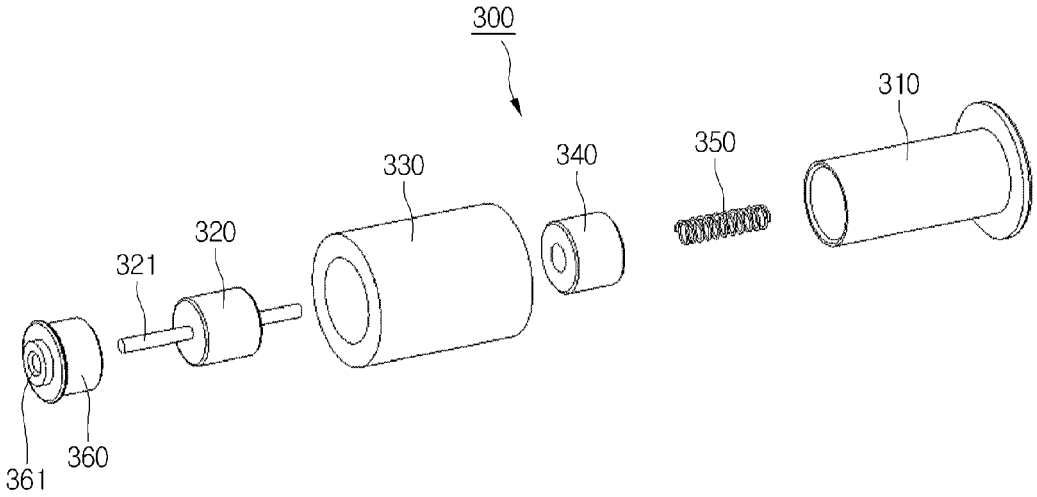
FIG. 4 is an exploded perspective view of a trip driving mechanism according to an embodiment.

FIG. 3 is a perspective view illustrating a shortage voltage trip device of a molded case circuit breaker according to an embodiment. FIG. 4 is an exploded perspective view of a trip driving mechanism according to an embodiment.

Referring to FIG. 3, a shortage voltage trip device 100 (hereinafter, referred to as a "trip device") of a molded case circuit breaker according to an embodiment is coupled to a molded case circuit breaker (not shown) (hereinafter, referred to as a "circuit breaker"). Also, the trip device 100 performs a trip operation to open a circuit of the circuit breaker when a voltage applied into the circuit is less than a rated voltage.

The trip device 100 performs one operation of a turn-off operation corresponding to an operation before the trip device 100 is connected to a power applied into the circuit, a turn-on operation in which the trip device 100 is connected to the power applied into the circuit, and a trip operation opening the circuit according to a voltage of the power applied into the circuit.

The trip device 100 may include a trip handle 120, a trip driving mechanism 200, a trip driving part 300, a trip lever 400, and first and second springs 510 and 520 within a casing 110.

A user may manipulate the trip handle 120 to perform the turn-off operation, the turn-on operation, and the trip operation. The trip handle 120 is rotatably disposed with respect to a handle rotation shaft 121 disposed within the casing 110. Here, a portion of the trip handle 120 is exposed to the outside of the casing 110, and remaining portions of the trip handle 120 including the handle rotation shaft 121 are disposed within the casing 110. The trip handle 120 is rotated between a turn-off position (see FIG. 3) and a turn-on position (see FIG. 5). The turn-off position represents a position of the trip handle 120 during the turn-off operation or the trip operation, and the turn-on position represents a position of the trip handle 120 during the turn-on operation.

Also, a linkage hole 123 is defined in a side of the trip handle 120 exposed to the outside of the casing 110. A linkage member (not shown) linked with the circuit breaker, substantially, a handle (not shown) provided in the circuit breaker during the trip operation may be inserted into the linkage hole 123. The linkage member passes through the linkage hole 123 and a hole (not shown) defined in the handle.

Although not shown, a handle spring is provided on the trip handle 120. The handle spring has a death point at one position of the trace of the trip handle 120 rotated between the turn-off position and the turn-on position. Thus, an elastic force of the handle spring acts on the trip handle 120 between the turn-off position and a position corresponding to the dead point so that the trip handle 120 is disposed at the turn-off position. However, the elastic force of the handle spring acts on the trip handle 120 between the turn-on position and the position corresponding to the dead point so that the trip handle 120 is disposed at the turn-on position.

The PCB 130 is electrically connected to the power applied into the circuit during the turn-on operation to supply driving current into the trip driving part 300. The PCB 130 is connected to a line-side terminal 111 and a power source-side terminal 113 through a movable lever 240 that will be described later. The PCB 130 supplies the driving current proportional to the voltage applied into the circuit into the trip driving part 300. In the current embodiment, a component for calculating a voltage of the power applied into the circuit may be removed from the PCB 130.

Also, the trip driving mechanism 200 is operated by being linked with the rotation of the trip handle 120. Also, the operation of the trip driving mechanism 200 may be selectively restricted by the trip lever 400 linked with the trip driving part 300. The trip driving mechanism 200 may include a link 210, a shaft 220, a latch 230, the movable lever 240, and a driving spring (not shown).

The link 210 may link the rotation of the trip handle 120 and a rotation of the shaft 220 with each other. For this, one end of the link 210 is hinge-coupled to the trip handle 120.

The shaft 220 is rotatably disposed with respect to a shaft rotation shaft 221 within the casing 110. Also, the other end of the link 210 is hinge-coupled to the shaft 220. The shaft 220 presses the first trip spring 510 to provide a moment into the first trip spring 510 during the turn-on operation. Also, the shaft 220 receives an elastic force from the first trip spring 510 during the trip operation.

The latch 230 is rotatably disposed with respect to a latch rotation shaft 231 within the casing 110. One side of the latch 230 may be hinge-coupled to the shaft 220 so that the latch 230 is rotated by being linked with the rotation of the shaft 220. The other side of the latch 230 is restricted by the trip lever 400 during the turn-off operation and the turn-on operation. However, the restriction of the one side of the latch 230 is released from the trip lever 400 during the trip operation.

Also, the movable lever 240 is connected to one side of the shaft 220. The movable lever 240 is electrically connected to the PCB 130. Also, the movable lever 240 is linked with the rotation of the shaft 220 and then rotated to selectively contact the power source-side terminal 113. That is, during the turn-off operation and the trip operation, the movable lever 240 is spaced from the power source-side terminal 113. Also, during the turn-on operation, the movable lever 240 contacts the power source-side terminal 113.

The driving spring applies an elastic force into the shaft 220, the latch 230, and the movable lever 240. In more detail, the driving spring has a death point at one position of the traces of the shaft 220, the latch 230, and the movable lever 240 which are rotated during the turn-off operation and the turn-on operation. Thus, during the turn-off operation, the elastic force of the driving spring acts in a direction in which the shaft 220, the latch 230, and the movable lever 240 are respectively rotated to positions when the turn-off operation is performed between positions of the shaft 220, the latch 230, and the movable lever 240 and a position corresponding to the death point. On the other hand, during the turn-on operation, the elastic force of the driving spring acts in a direction in which the shaft 220, the latch 230, and the movable lever 240 are respectively rotated to positions when the turn-on operation is performed between positions of the shaft 220, the latch 230, and the movable lever 240 and a position corresponding to the death point.

The trip driving part 300 is operated by the driving current transmitted from the PCB 130 to provide a driving force into the trip lever 400 which restricts or releases the operation of the trip driving mechanism 200, substantially, the rotation of the latch 230.

Referring to FIG. 4, the trip driving part 300 includes a bobbin 310, a moving coil 320, a coil 330, a permanent magnet 340, a core spring 350, and a bobbin cap 360.

The bobbin 310 has a hollow cylindrical shape. The moving core 320, the permanent magnet 340, and the core spring 350 are disposed inside the bobbin 310, and the coil 330 is disposed outside the bobbin 310.

Also, the moving core 320 is movably disposed within the bobbin 310. A driving protrusion 321 is disposed on the moving core 320. The driving protrusion 321 extends toward one side of the moving core 320. The driving protrusion 321 selectively protrudes to the outside of the bobbin 310 according to the movement of the moving core 320. Hereinafter, a position of the moving core 320 when the driving protrusion 321 is disposed within the bobbin 310 is referred to a first position (see FIGS. 3 and 5), and a position of the moving core 320 when the driving protrusion 321 maximally protrudes to the outside of the bobbin 310 is referred to as a second position (see FIG. 6). The moving core 320 is disposed at the first position during the turn-off operation and the turn-on operation and is disposed at the second position during the trip operation.

The coil 330 and the permanent magnet 340 provide an electromagnetic force into the moving core 320 so that the moving core 320 is disposed at the first position. In detail, the coil 330 receives the driving current from the PCB 130 to provide the electromagnetic force into the moving core 320 so that the moving core 320 is disposed at the first position. Also, the permanent magnet 340 provides a magnetic force into the coil 330 so that the coil 330 is disposed at the first position. Here, an external force acting on the moving core 320 by the electromagnetic force of the coil 330 and the magnetic force of the permanent magnet 340 may be applied in a right direction in FIG. 3.

The core spring 350 provides an elastic force into the moving coil 330 so that the moving coil 330 is disposed at the second position. For example, the core spring 350 is pressed by the moving coil 330 in a state where the moving coil 330 is disposed at the first position by the coil 330 and the permanent magnet 340. Thus, an external force acting on the moving core 320 by the elastic force of the core spring 350 may be applied in a direction opposite to the direction applied into the moving cover 320 by the electromagnetic force of the coil 330 and the magnetic force of the permanent magnet 340, i.e., in a left direction in FIG. 3.

The bobbin cap 360 may cover one end of the bobbin 310. The moving core 320 is moved into the bobbin 320 covered by the bobbin cap 360. A through hole 361 through which the driving protrusion 321 passes is define din the bobbin cap 360.

Referring again to FIG. 3, the trip lever 400 is rotatably disposed with respect to a lever rotation shaft 410 within the casing 110. The trip lever 400 may restrict the operation of the trip driving part 300 or selectively restrain the rotation of the latch 230 by being linked with the operation of the trip driving part 300. The trip lever 400 presses the driving protrusion 321 so that the trip driving part 300, substantially, the moving core 320 is disposed at the first position during the turn-off operation. Also, the trip lever 400 restricts the rotation of the latch 230 during the turn-on operation. Also, the trip lever 400 releases the restriction of the rotation of the latch during the trip operation.

The trip lever 400 includes a restriction protrusion 420, a linkage rib 430, and first and second support protrusions 440 and 450. One side of the latch 230 selectively contacts the restriction protrusion 420. Also, the linkage rib 430 extends from one side of the trip lever 400 to selectively contact the trip driving part 300, substantially, the driving protrusion 321. One end of the first trip spring 510 is supported by the first support protrusion 440. Here, one end of the first trip spring 510 is supported by the first support protrusion 440 during only the turn-off operation. One end of the second trip spring 520 is supported by the second support protrusion 450. The second support protrusion 450 may be provided in pair. The pair of second support protrusions 450 is disposed on both sides of the second trip spring 520 in a state where the one end of the second trip spring 520 is supported by the second support protrusion 450.

The first trip spring 510 applies an elastic force into the shaft 220 or the trip lever 400. A torsion spring disposed on the lever rotation shaft 410 may be used as the first trip spring 510. One end of the first trip spring 510 is supported by one side of the shaft 220 or the first support protrusion 440, and the other end of the first trip spring 510 is supported by one side of the casing 110. That is, one end of the first trip spring 510 is supported by the first support protrusion 440 during only the turn-off operation. Also, one end of the first trip spring 510 is supported by one side of the shaft 220 during the turn-one operation and the trip operation. Since one end of the first trip spring 510 is pressed by the shaft 220, an additional moment may be applied to the first trip spring 510. The first trip spring 510 may be maintained always in a state in which the moment is applied in a clockwise direction in FIG. 3.

Thus, the elastic force of the first trip spring 510 may act on the trip lever 400 in the clockwise direction in FIG. 3 during the turn-off operation. Also, the elastic force of the first trip spring 510 may act on the shaft 220 in a counterclockwise direction in FIG. 3 during the turn-on operation and the trip operation. Also, the elastic force of the first trip spring 510 substantially applied into the trip lever 400 may act on the moving core 320 in a right direction in FIG. 3.

The second trip spring 520 selectively applies an elastic force into the trip lever 400. In more detail, the second trip spring 520 is disposed on the handle rotation shaft 121. As described above, the other end of the second trip spring 520 is maintained as a free end in the state where the one end of the second trip spring 520 is supported by the second support protrusion 450. Here, the one end of the second trip spring 520 is supported by the second support protrusion 450 in a state where the one end of the second trip spring 520 is bent in a predetermined angle or curvature so that the elastic force for rotating the trip lever 400 in the counterclockwise direction is applied to the trip lever 400. Thus, the elastic force of the second trip spring 520 applied into the trip lever 400 may also act in the right direction in FIG. 3, like the elastic force of the first trip spring 510.

In the current embodiment, an external force F1 acting on the moving core 320 by the electromagnetic force of the coil 330, an external force F2 acting on the moving core 320 by the magnetic force of the permanent magnet 340, an external force F3 acting on the moving core 320 by the elastic force of the core spring 350, an external force F4 acting on the moving core 320 by the elastic force of the first trip spring 510 applied into the trip lever 400, and an external force F5 acting on the moving core 320 by the elastic force of the second trip spring 520 applied into the trip lever 400 may satisfy the following Formulas.

$$F2+F4+F5 \geq F3$$ [Formula 1]—During turn-off operation $$F1+F2+F5 > F3$$ [Formula 2]—Rated voltage or more $$F1+F2+F5 < F3$$ [Formula 3]—During trip operation (rated voltage or less)

Formula 1 is applied during the turn-off operation. That is, in a case of the turn-off operation, since driving current is not applied into the coil 330, only the external forces by the permanent magnet 340, the core spring 350, and the first and second trip springs 510 and 520 act substantially on the moving core 320. However, the external forces by the permanent magnet 340 and the first and second trip springs 510 and 520 and the external force by the core spring 350 act on the moving core 320 in directions opposite to each other. Thus, to maintain the state of FIG. 3, Formula 1 should be satisfied.

During the turn-on operation, a voltage of a power applied into the circuit may be maintained to the rated voltage or more. Also, during the turn-on operation, since the elastic force of the first trip spring 510 is applied into the shaft 220, only the external forces by the coil 330, the permanent magnet 340, the core spring 350, and the second trip spring 520 act on the moving core 320. However, the external forces by the coil 330, the permanent magnet 340, and the second trip spring 520 and the external force by the core spring 350 act in directions opposite to each other. Thus, to maintain the turn-on operation (see FIG. 5), Formula 2 should be satisfied.

On the other hand, during the trip operation, the elastic force of the first trip spring 510 is continuously applied into the shaft 220. Thus, during the trip operation, the external forces may be applied into the moving core 320, like during the turn-on operation. However, substantially, since the driving current applied into the coil 330 is reduced when compared to that during the turn-on operation, the external force acting on the moving core 320 by the coil 330 may be reduced. Thus, Formula 3 should be satisfied.

Hereinafter, an operation of the molded case circuit breaker will be described in detail with reference to the accompanying drawings.

Figure 5:
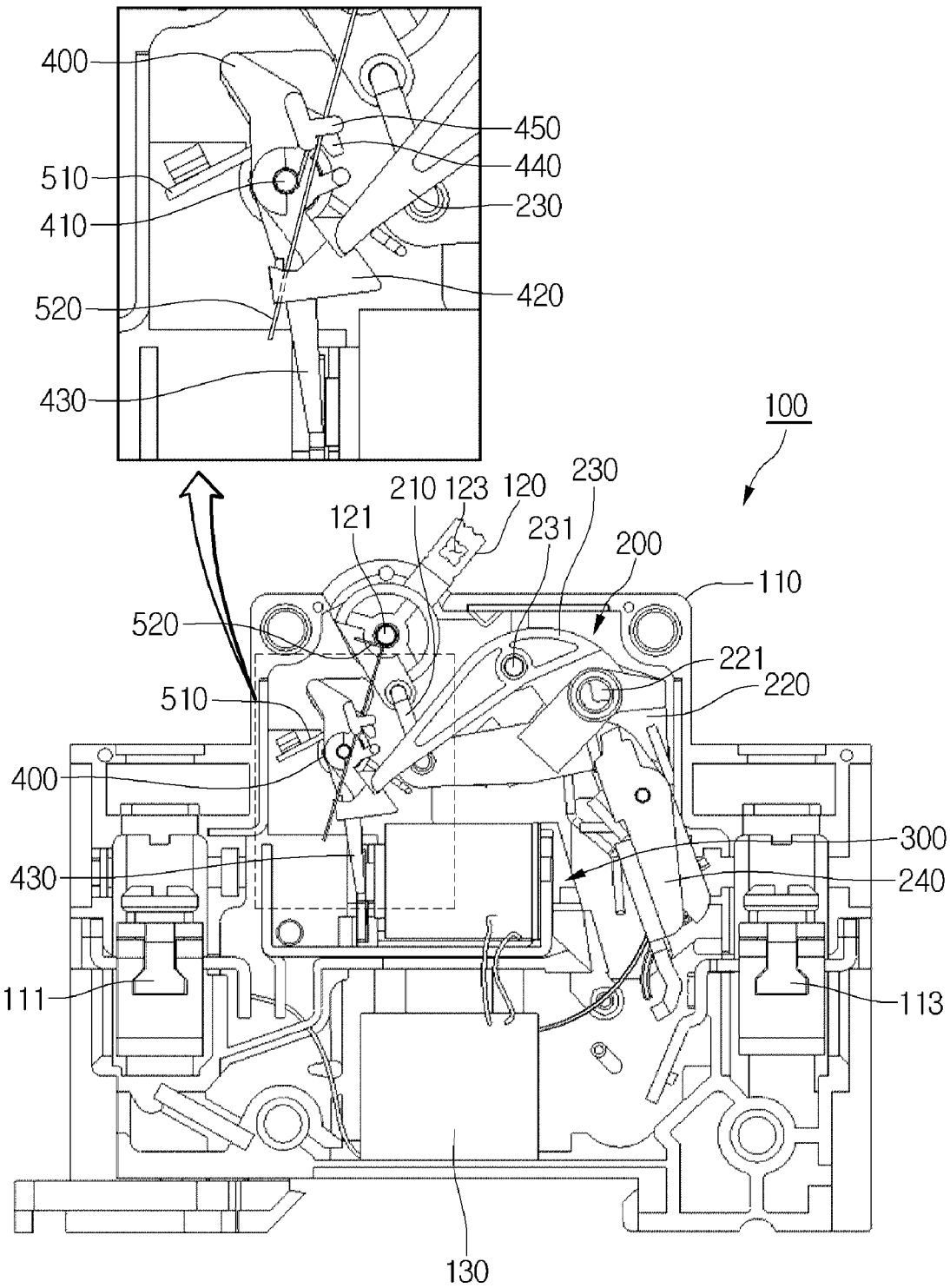
FIGS. 5 to 7 are perspective views illustrating an operation of the shortage voltage trip device of the molded case circuit breaker according to an embodiment.
Figure 6:
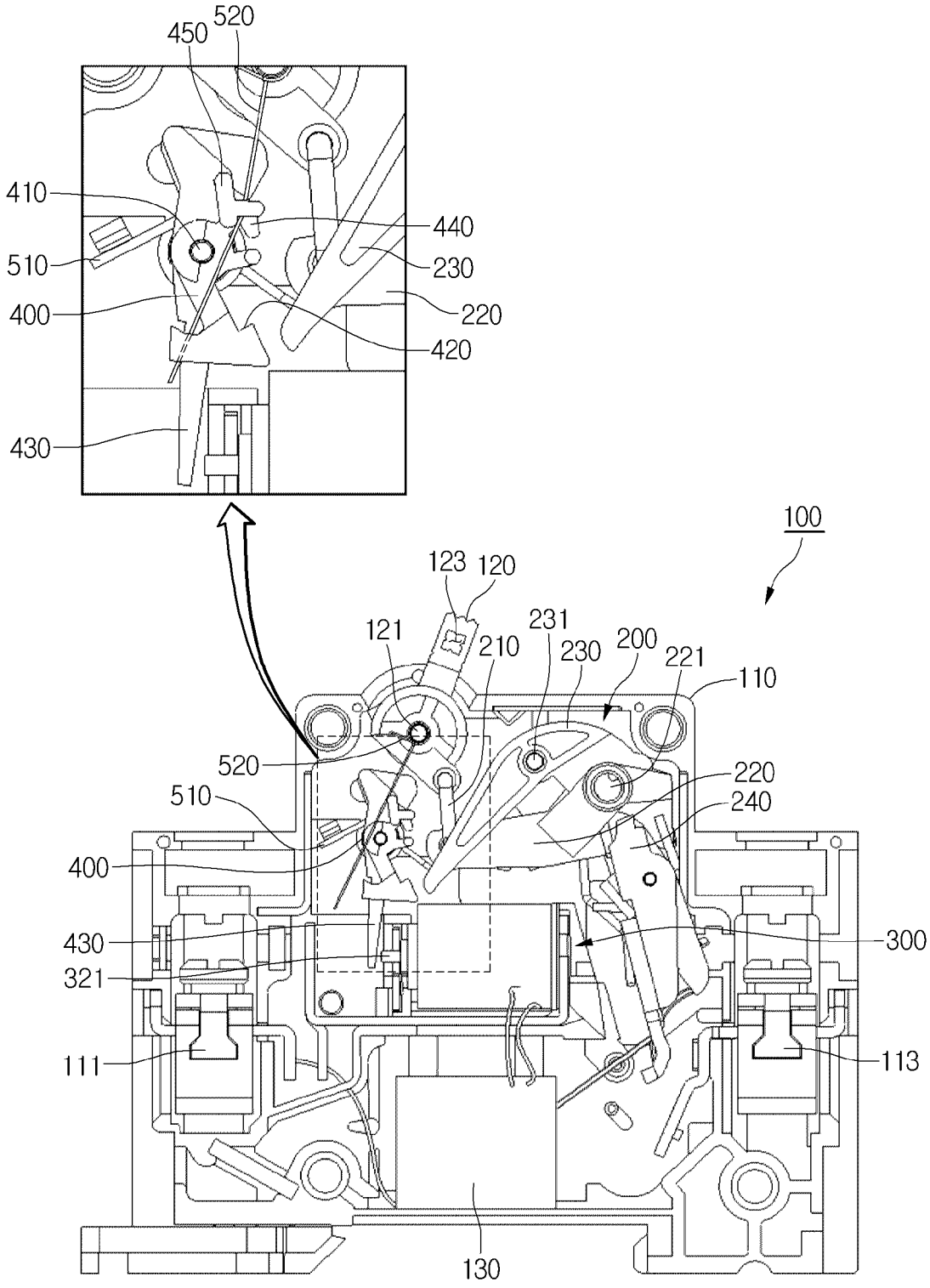
Figure 7:
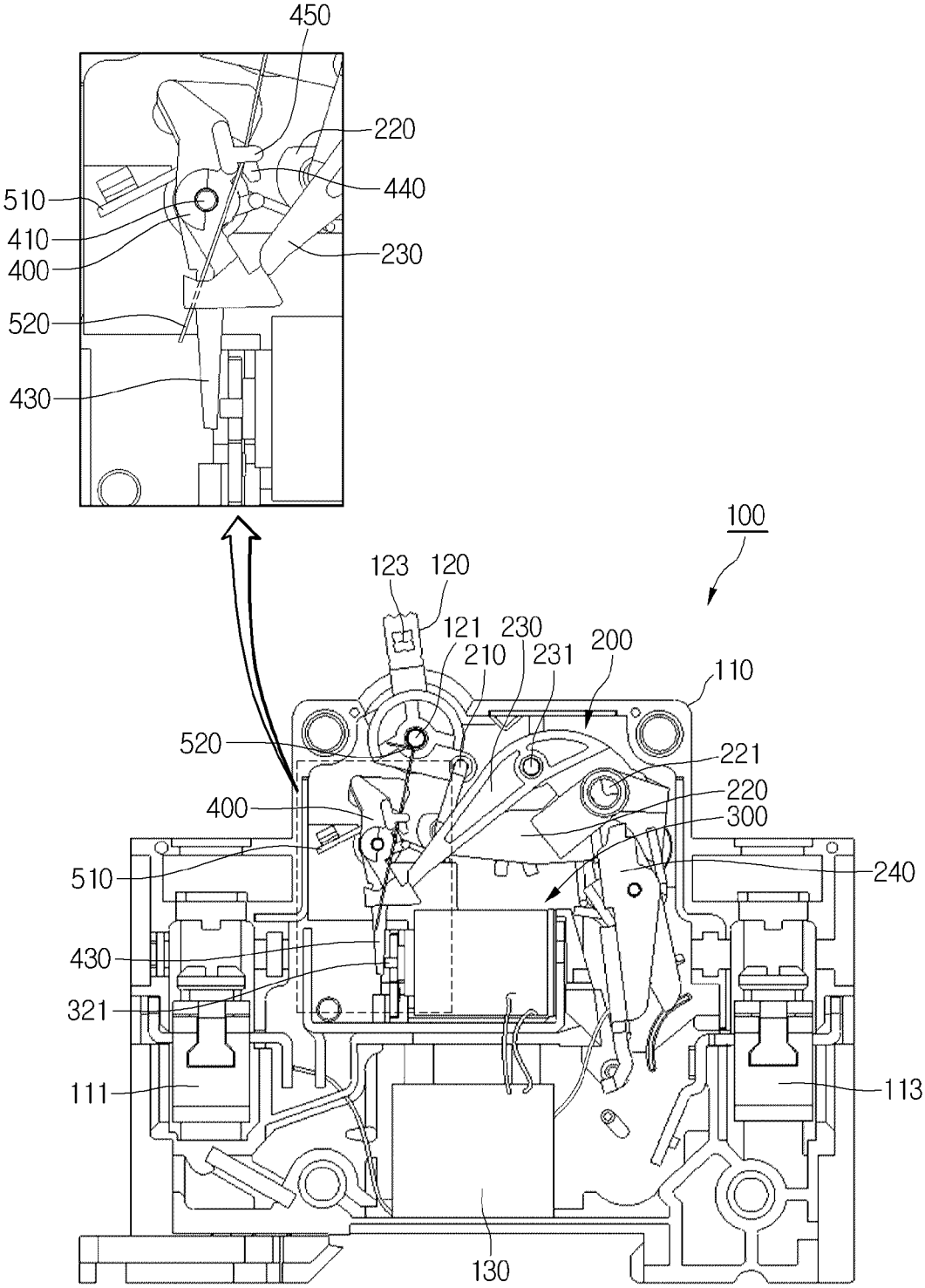

FIGS. 5 to 7 are perspective views illustrating an operation of the shortage voltage trip device of the molded case circuit breaker according to an embodiment.

Referring to FIG. 3, in a state of a turn-off operation of a trip device 100, a trip handle 120 is disposed at a turn-off position. Also, the rotation of a latch 230 may be restricted by contacting a restriction protrusion 420 of a trip lever 400. Also, one end of a first trip spring 510 is maintained in a state where the one end is supported by the trip lever 400.

Since a movable lever 240 is spaced from a power source-side terminal 113, driving current is not supplied from a PCB 130 into a coil 330. Thus, only an external force F2 by a permanent magnet 340, an external force F3 by a core spring 350, an external force F4 by the first trip spring 510 applied into the trip lever 400, and an external force F5 by a second trip spring 520 applied into the trip lever 400 act on the moving core 320. However, since the external forces F2, F3, F4, and F5 satisfy Formula 1, an external force acts on the moving core in a right direction in FIGS. 5 to 7. Thus, the moving core 320 may be maintained in a state the moving core 320 is disposed at a first position.

In this state, referring to FIG. 5, the trip handle 120 is rotated with respect to a handle rotation shaft 121 in a clockwise direction in the drawings to perform a turn-on operation of the trip device 100. Thus, the circuit breaker is rotated by being linked with the rotation of the trip handle 120 to close a circuit.

Also, when the trip handle 120 is rotated, the shaft 220 is linked with the rotation of the trip handle 120 and then is rotated with respect to a shaft rotation shaft 221 in a counterclockwise direction in the drawings. Also, when the shaft 220 is rotated, the movable lever 240 is linked with the rotation of the shaft 220 and then is rotated in the counterclockwise direction in the drawings. Here, since the rotation of the latch 230 is restricted by the trip lever 400, the latch 230 is not linked with the rotation of the shaft 220 and thus is not rotated. Here, the rotation of the shaft 220 and the movable lever 240 may be performed to overcome an elastic force of a driving spring.

Also, when the trip handle 120 is rotated and disposed at a turn-on position, the shaft 220 is rotated with respect to the shaft rotation shaft 221 to press one end of the first trip spring 510 in the clockwise direction in the drawings. Thus, since the one end of the first trip spring 510 supported by the trip lever 400 is supported by one side of the shaft 220, the elastic force of the first trip spring 510 is applied into the shaft 220. Here, since the shaft 220 is rotated to pass through a dead point of the driving spring, the elastic force of the driving spring acts so that the shaft 220 is rotated in the counterclockwise direction in the drawings. Also, since the rotation of the latch 230 is restricted by the trip lever 400, the shaft 220 is not rotated by the elastic force of the first trip spring 510.

When the trip handle 120 is rotated and disposed at the turn-on position, the movable lever 240 contacts the power source-side terminal 113. Thus, the PCB 130 is electrically connected to a power applied into the circuit, and thus, the driving current is applied from the PCB 130 into the coil 330.

As described above, due to the rotation of the trip handle 120 and the apply of the driving current into the coil 330, the external force F5 by the elastic force of the second rip spring 520 applied into the trip lever 400 and the external force F1 by the electromagnetic force of the coil 330 may additionally act on the moving core 320. Also, due to the rotation of the shaft 220, the external force F4 acting on the moving core 320 is removed by the elastic force of the first trip spring 510 applied into the trip lever 400. However, the external force F1 by the electromagnetic force of the coil 330, the external force F2 by the elastic force of the permanent magnet 340, the external force F3 by the elastic force of the core spring 350, and the external force F5 by the elastic force of the second trip spring 520 which act on the moving core 320 satisfy Formula 2. Thus, the external force acts on the moving core 320 in the right direction in the drawings to allow the moving core 320 to be maintained at the first position.

When the trip handle 120 is rotated to perform the turn-on operation of the trip device 100, the handle of the molded case circuit breaker may be rotated by being linked with the rotation of the trip handle 120. Thus, substantially, the turn-on operation of the trip device 100 and the turn-on operation of the molded case circuit breaker may be performed at the same time and at once.

Also, when a voltage of the power applied into the circuit drops down to the rated voltage or less, the trip device 100 performs a trip operation. First, when a voltage of the power applied into the circuit drops down, driving current applied into the coil 330 from the PCB 130 is reduced in proportion to the dropping voltage. Thus, since the electromagnetic force of the coil 330 is reduced, the external force F1 by the electromagnetic force of the coil 330, the external force F2 by the elastic force of the permanent magnet 340, the external force F3 by the elastic force of the core spring 350, and the external force F5 by the elastic force of the second trip spring 520 which act on the moving core 320 satisfy Formula 3. That is, the external force acts on the moving core 320 in the left direction in the drawings. Thus, the moving core 320 is moved in the left direction in the drawings, i.e., from the first position to the second position.

Also, when the moving core 320 is moved toward the second position, the trip lever 400, i.e., a linkage rib 430 is pressed by the moving core 320, substantially, the driving protrusion 321. Thus, the trip lever 400 is rotated with respect to a lever rotation shaft 410 in the counterclockwise direction in the drawings.

When the trip lever 400 is rotated, one side of the latch 230 is spaced from the restriction protrusion 420. However, the elastic force of the first trip spring 510 acts on the shaft 220 in the counterclockwise direction in the drawings. Thus, the shaft 220 is rotated with respect to the shaft rotation shaft 221 in the clockwise direction by the elastic force of the first trip spring 510. Also, when the shaft 220 is rotated to pass through the dead point of the driving spring, the shaft 220 is rotated by the elastic force of the driving spring. Also, the latch 230 is linked with the rotation of the shaft 220 and is rotated with respect to the latch rotation shaft 231 in the clockwise direction in the drawings.

The trip handle 120 is linked with the rotation of the shaft 220 and is rotated with respect to the handle rotation shaft 121 in the counterclockwise direction in the drawings. Substantially, when the trip handle 120 is linked with the rotation of the shaft 220 and is rotated to pass through the dead point of the handle spring, the trip handle 120 is rotated by the elastic force of the handle spring and thus is disposed at the turn-off position.

Also, the movable lever 240 is linked with the rotation of the shaft 220 and is rotated in the counterclockwise direction in the drawings, thereby being spaced from the power source-side terminal 113. Thus, the power applied into the PCB 130 is interrupted, and also, the driving current applied into the coil 330 from the PCB 130 is interrupted. Also, when the driving current applied into the PCB 130 is interrupted, the external force F1 acting on the moving core 320 may be substantially removed by the electromagnetic force of the coil 330.

Also, when the shaft 220 is rotated, the one end of the first trip spring 510 is supported by the trip lever 400 in the state where the one end of the first trip spring 510 is supported by the one side of the shaft 220. Thus, the elastic force of the first trip spring 510 acts on the trip lever 400. Also, the trip lever 400 is rotated with respect to the lever rotation shaft 410 in the counterclockwise direction by the elastic force of the first trip spring 510 to press and push the moving core 320 in a direction of the first position. Also, when the moving core 320 is moved toward the first position to approach the permanent magnet 340, the external force F2 by the elastic force of the permanent magnet 340, the external force F3 by the elastic force of the core spring 350, and the external force F4 by the first trip spring 510 act on the moving core 320. However, since the external forces F2, F3, and F4 satisfy Formula 1, the moving core 320 may be maintained at the first position.

The operation of the trip driving part 300 during the trip operation of the trip device 100 as described above may be understood with reference to FIGS. 6 and 7. Finally, the trip device 100 after the trip operation may be disposed at the same position as that during the turn-off operation as shown in FIG. 3. Here, when the trip handle 120 is disposed at the turn-off position, the handle of the circuit breaker may be disposed at the turn-off position by being linked with the operation of the trip handle 120. Thus, the circuit may be broken by the circuit breaker.

It should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

In the above-described embodiment, the operation of the drip driving part is limitedly described with respect to the position of the moving core. However, when the moving core is disposed at the first position, the trip driving part, the trip driving part may be in a stop state. Also, when the moving core is disposed at the second position, the trip driving part may be in a moving state.

Also, in the above-described embodiment, the elastic force of the second trip spring continuously acts on the trip lever. However, the elastic force of the second trip spring is a negligible quantity when compared to that of the core spring or the first trip spring. Thus, even though the second trip spring is moved, the trip operation may be performed. However, the elastic force of the second trip spring may prevent the trip lever from being shaken when the trip lever is rotated from the trip position to the turn-off position.

The shortage voltage trip device of the molded case circuit breaker according to the embodiment may have following effects.

First, in the embodiment, the handle of the molded case circuit breaker and the trip handle of the trip device are linked with each other. Thus, according to the embodiment, the user may manipulate one of the handle and the trip handle to more simply switch the circuit.

Also, in the embodiment, when the voltage of the power applied into the circuit is less than the rated voltage, the trip operation may be performed regardless of the range or intensity of the voltage. Therefore, the operation reliability of the product may be improved.

Also, it may be unnecessary to compare and determine the intensity of the voltage of the power applied into the circuit. Thus, the trip operation may be performed according to the external forces acing on the trip driving part in proportion to the voltage of the power. Therefore, the product may have a more simplified structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A shortage voltage trip device of a molded case circuit breaker, which performs a turn-on operation connected to a circuit switched by the molded case circuit breaker, a turn-off operation broken from the circuit, and a trip operation in a case where a voltage of a power applied into the circuit is less than a rated voltage, the shortage voltage trip device comprising:

a casing;

a trip handle rotatably disposed in the casing, the trip handle being selectively disposed at a turn-of position and a turn-on position;

a printed circuit board (PCB) disposed in the casing, the PCB being selectively connected to a line-side terminal and a power source-side terminal of the circuit;

a trip driving mechanism linked with the rotation of the trip handle;

a trip driving part selectively receiving an electromagnetic force from the PCB connected to the line-side terminal and the power source-side terminal, the trip driving part being operated or stopped according to an intensity of the electromagnetic force received from the PCB;

a trip lever rotatably disposed within the casing, the trip lever being rotated by being linked with the operation of the trip driving part to allow the trip driving mechanism to be selectively operated; and a first trip spring applying an elastic force into the trip lever so that the trip driving part is rotated in a direction for maintaining the stopped state of the trip driving part or into the trip driving mechanism so that the trip driving mechanism is operated by being linked with the rotation of the trip handle disposed at the turn-off position, wherein, the voltage applied into the circuit is greater than the rated voltage, the trip driving part is stopped, and the operation of the trip driving mechanism is restricted by the trip lever, and when the voltage applied into the circuit is less than the rated voltage, the trip driving part is operated, and the restriction of the trip driving mechanism is released by the trip lever rotated by being linked with the operation of the trip driving part, wherein the trip driving part comprises a movable driving core, a coil generating an electromagnetic force by driving current transmitted from the PCB;

a permanent magnet generating a magnetic force acting on the movable driving core; and a core spring applying an elastic force into the movable driving core, the driving core comprises a protrusion protruding to the outside of the trip driving part, and when the voltage applied into the circuit is less than the rated voltage, the protrusion protrudes to the outside of the trip driving part to rotate the trip lever, wherein an external force (F1) acting on the movable driving core by the electromagnetic force of the coil and an external force (F2) acting on the movable driving core by the magnetic force of the permanent magnet act in a direction opposite to that of an external force (F3) acting on the movable driving core by the elastic force of the core spring, and the elastic force of the first trip spring applied into the trip lever acts on the movable driving core as an external force (F4) in the same direction as the external force (F1) acting on the movable driving core by the electromagnetic force of the coil and the external force (F2) acting on the movable driving core by the magnetic force of the permanent magnet.

2. The shortage voltage trip device according to claim 1, wherein, when the voltage applied into the circuit is greater than the rated voltage, the trip lever contacts the trip driving mechanism, and when the voltage applied into the circuit is less than the rated voltage, the trip lever is spaced from the trip driving mechanism by the trip driving part.

3. The shortage voltage trip device according to claim 1, wherein the trip driving mechanism comprises:

a shaft connected to the trip handle by a link;

a latch rotated by being linked with the rotation of the shaft, the latch being selectively restricted by the trip laver; and a movable lever rotated by being linked with the rotation of the shaft, the movable lever selectively contacting one of the line-side terminal and the power source-side terminal in a state where the movable lever is electrically connected to the PCB.

4. The shortage voltage trip device according to claim 3, wherein, the trip handle is rotated from the turn-off position to the turn-on position, the shaft presses the first trip spring while being rotated by being linked with the rotation of the trip handle.

5. The shortage voltage trip device according to claim 3, wherein the latch is selectively restricted or released by the trip lever.

6. The shortage voltage trip device according to claim 1, wherein the first trip spring comprises a torsion spring disposed on a rotation shaft of the trip lever.

7. The shortage voltage trip device according to claim 6, wherein the first trip spring has one end supported inside the casing and the other end supported by one side of the trip lever or the trip driving mechanism.

8. The shortage voltage trip device according to claim 1, wherein, during the turn-off operation, the external force (F3) by the elastic force of the core spring and the external force (F4) by the elastic force of the first trip spring applied into the trip lever act on the moving core, and the sum of the external force (F2) and the external force (F4) exceeds the external force (F3) acting on the moving core by the elastic force of the core spring to maintain a stopped state of the moving core.

9. The shortage voltage trip device according to claim 1, wherein, during the turn-on operation, the external force (F1) by the electromagnetic force of the coil, the external force (F2) by the magnetic force of the permanent magnet, and the external force (F3) by the elastic force of the core spring act on the moving core, the sum of the external force (Fl) and the external force (F2) exceeds the external force (F3) acting on the moving core by the elastic force of the core spring to maintain a stopped state of the moving core.

10. The shortage voltage trip device according to claim 9, wherein, during the trip operation, the external force (F1) by the electromagnetic force of the coil of the external forces acting on the moving core during the turn-on operation is reduced in proportion to reduction of the power applied into the circuit, and the external force (F3) exceeds the sum of the external force (F1) and the external force (F2), and the moving core is moved to allow the protrusion of the moving core to rotate the trip lever.

11. The shortage voltage trip device according to claim 1, further comprising a second trip spring applying an elastic force into the trip lever, wherein the elastic force of the second trip spring applied into the trip lever acts on the moving core as an external force (F5) in the same direction as the external force (F1) and the external force (F2).

12. The shortage voltage trip device according to claim 11, wherein, during the turn-off operation, only the external (F2), the external (F3), the external (F4), and the external (F5) by the elastic force of the second trip spring applied into the trip lever act on the moving core, and the sum of the external (F2), the external (F4), and the external (F5) exceeds the external force (F3) acting on the moving core by the elastic force of the core spring to maintain a stopped state of the moving core.

13. The shortage voltage trip device according to claim 11, wherein, during the turn-on operation, the external (F1), the external (F2), the external (F3), and the external (F5) by the elastic force of the second trip spring applied into the trip lever act on the moving core, and the sum of the external (F1), the external (F2), and the external (F5) exceeds the external force (F3) acting on the moving core by the elastic force of the core spring to maintain a stopped state of the moving core.

14. The shortage voltage trip device according to claim 13, wherein, during the trip operation, the external force (F1) by the electromagnetic force of the coil of the external forces acting on the moving core during the turn-on operation is reduced in proportion to reduction of the power applied into the circuit, and the external force (F3) exceeds the sum of the external force (F1), the external force (F2), and the external force (F2), and the moving core is moved to allow the protrusion of the moving core to rotate the trip lever.

* * * * *